US005318735A

United States Patent [19]

Kozulla

[11] Patent Number: 5,318,735

[45] Date of Patent: Jun. 7, 1994

[54] PROCESS OF MAKING HIGH THERMAL BONDING STRENGTH FIBER

[75] Inventor: Randall E. Kozulla, Conyers, Ga.

[73] Assignee: Hercules Incorporated, Wilmington, Del.

[*] Notice: The portion of the term of this patent subsequent to Jan. 25, 2011, has been disclaimed.

[21] Appl. No.: 683,635

[22] Filed: Apr. 11, 1991

Related U.S. Application Data

[63] Continuation-in-part of Ser. No. 474,897, Feb. 5, 1990, abandoned.

[51] Int. Cl.[5] ..... D01F 6/04; D01F 8/06; D01F 11/04

[52] U.S. Cl. ..... 264/83; 264/171; 264/211; 264/211.14; 264/211.15; 264/211.17; 264/237

[58] Field of Search ..... 264/29.2, 83, 210.6, 264/211, 211.14, 211.15, 211.17, 171, 237

[56] References Cited

U.S. PATENT DOCUMENTS

| | | | |
|---|---|---|---|
| 2,335,922 | 7/1943 | Dreyfus . | |
| 2,715,075 | 8/1955 | Wolinski | 264/83 X |
| 2,715,076 | 8/1955 | Wolinski | 264/83 X |
| 2,715,077 | 8/1955 | Wolinski | 264/83 X |
| 2,985,995 | 8/1961 | Bunting, Jr. et al. . | |
| 3,364,537 | 1/1968 | Bunting, Jr. et al. . | |
| 3,428,506 | 2/1969 | Johnstone | 156/148 |
| 3,484,916 | 12/1969 | Johnstone . | |
| 3,505,164 | 4/1970 | Oppenlander . | |
| 3,509,013 | 4/1970 | Oppenlander . | |
| 3,516,899 | 6/1970 | Saunders . | |
| 3,533,904 | 10/1970 | Jurkiewitsch . | |
| 3,597,268 | 8/1971 | Smith . | |
| 3,616,168 | 8/1971 | Johnstone . | |
| 3,663,675 | 5/1972 | Fukuma et al. | 264/168 |
| 3,693,341 | 9/1972 | Higgins, Jr. | 57/333 |
| 3,807,917 | 4/1974 | Shimoda et al. . | |
| 3,862,265 | 1/1975 | Steinkamp et al. . | |
| 3,898,209 | 8/1975 | Watson et al. | 264/83 X |
| 3,907,057 | 9/1975 | Reddekopp . | |
| 3,907,957 | 9/1975 | Shaffer . | |
| 4,115,620 | 9/1978 | Gupta et al. | 428/374 |
| 4,134,882 | 1/1979 | Frankfort et al. . | |
| 4,193,961 | 3/1980 | Roberts . | |
| 4,195,051 | 3/1980 | Frankfort et al. . | |
| 4,251,200 | 2/1981 | Parkin | 425/131.5 |
| 4,259,399 | 3/1981 | Hill | 428/288 |
| 4,303,606 | 12/1981 | Roberts . | |
| 4,347,206 | 8/1982 | Roberts . | |
| 4,438,238 | 3/1984 | Fukushima et al. | 525/240 |
| 4,480,000 | 10/1984 | Watanabe et al. | 428/284 |
| 4,500,384 | 2/1985 | Tomioka et al. | 156/290 |
| 4,511,615 | 4/1985 | Ohta | 428/198 |
| 4,578,414 | 3/1986 | Sawyer et al. | 524/310 |
| 4,592,943 | 6/1986 | Cancian et al. | 428/171 |
| 4,626,467 | 12/1986 | Hostetter | 428/288 |
| 4,632,861 | 12/1986 | Vassilatos | 428/296 |

(List continued on next page.)

FOREIGN PATENT DOCUMENTS

| | | |
|---|---|---|
| 279511 | 8/1988 | European Pat. Off. . |
| 445536 | 9/1991 | European Pat. Off. . |
| 1142065 | 9/1957 | France . |
| 48-18519 | 3/1973 | Japan . |
| 3-92416 | 4/1991 | Japan . |
| 34908 | 1/1957 | Luxembourg . |
| 738474 | 10/1955 | United Kingdom . |
| 2121423 | 12/1983 | United Kingdom . |

OTHER PUBLICATIONS

English Language abstract of Japanese Patent 48-018519 to Sekisui Chem. Co. Ltd. (Mar. 8, 1973).

English Language abstract of Japanese Patent 3-092416 to Daiwa Spinning K.K. (Apr. 17, 1991).

Deopura et al, "A Study of Blends of Different Molecu- (List continued on next page.)

*Primary Examiner*—Leo B. Tentoni

[57] ABSTRACT

Radial differential melt flow rate melt spun fiber, preparation thereof utilizing threadline oxidative chain scission degradation of hot fiber extruded from polyolefin polymer component(s) having a broad molecular weight distribution in conjunction with a delayed or slow quench step, and corresponding high strength nonwoven material obtained therefrom.

70 Claims, 1 Drawing Sheet

U.S. PATENT DOCUMENTS

Figure 2:
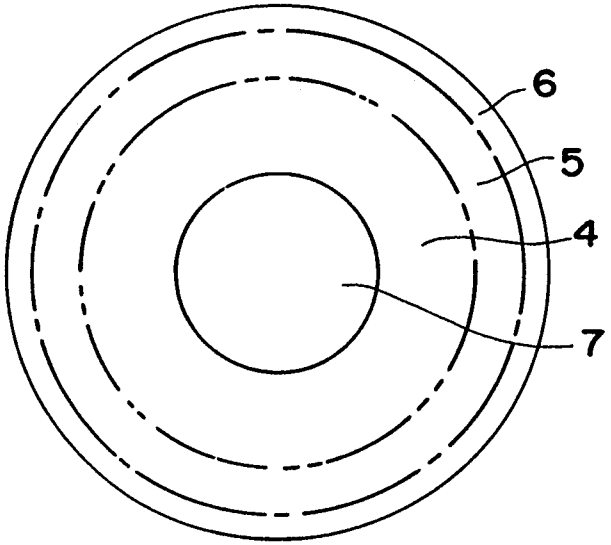

| | | | |
|---|---|---|---|
| 4,634,739 | 1/1987 | Vassilatos | 525/240 |
| 4,680,156 | 7/1987 | Collier | 264/171 |
| 4,717,325 | 1/1988 | Fujimura et al. | 425/131.5 |
| 4,770,925 | 9/1988 | Uchikawa et al. | 428/219 |
| 4,804,577 | 2/1989 | Hazelton et al. | 428/224 |
| 4,828,911 | 5/1989 | Morman | 428/288 |
| 4,830,904 | 5/1989 | Gessner et al. | 428/219 |
| 4,840,847 | 6/1989 | Ohmae et al. | 428/373 |
| 4,842,922 | 6/1989 | Krupp et al. | 428/190 |
| 4,874,666 | 10/1989 | Kubo et al. | 428/398 |
| 4,883,707 | 11/1989 | Newkirk | 428/219 |
| 4,909,976 | 3/1990 | Cuculo et al. | 264/211.15 |
| 5,009,951 | 4/1991 | Ohmae et al. | 428/294 |
| 5,066,723 | 11/1991 | Randall, Jr. et al. | 525/194 |

OTHER PUBLICATIONS lar Weights of Polypropylene" *Journal of Applied Polymer Science*, vol. 31, 2145–2155 (1986).

Legare, 1986 TAPPI Synthetic Fibers For West System and Thermal Bonding Applications, Boston Park Plaza Hotel & Towers, Boston, Mass., Oct. 9–10, 1986, "Thermal Bonding of Polypropylene Fibers in Nonwovens", pp. 1–13 and attached Tables and Figures.

Kloos, The Plastics and Rubber Institute, The Conference Department, Fouth International Conference On Polypropylene Fibers and Textiles, East Midlands Conference Centre, Nottinghas, London, UK: Wednesday 23 to Friday 23 Sep. 1987, "Dependence of Structure and Properties of Melt Spun Polypropylene Fibers on Molecular Weight Distribution", pp. i and 6/1–6/10.

Durcova et al., "Structure of Photoxidized Polypropylene Fibers", *Polymer Science U.S.S.R.*, vol. 29, No. 10 (1987), pp. 2351–2357.

Fan et al., "Effects of Molecular Weight Distribution on the Melt Spinning of Polypropylene Fibers", *Journal of Polymer Engineering*, vol. 5, No. 2 (1985) pp. 95–123.

Jones, The Plastics and Rubber Institute, The Conference Department, Fourth International Conference on Polypropylene Fibers and Textiles, East Midlands Conference Centre, Nottinghas, London, UK: Wednesday 23 to Friday 25 Sep. 1987, "A Study of Resin Melt Flow Rate and Polydispersity Effects on the Mechanical Properties of Melt Blown Polypropylene Webs", pp. i and 46/1–46/10.

Mahajan et al., "Fibers Spun From Blends of Different Molecular Weights of Polypropylene", *Journal of Applied Polymer Science*, vol. 43, 49–56 (1991).

Seiler and Goller, "Propylene (PP)" *Kunststoffe* 80 (1990) 10, pp. 1085–1092.

Trent et al., "Ruthenium Tetroxide Staining of Polymers for Election Microscopy" *Macromolecules*, vol. 16 No. 4, 1983.

Zeichner and Patel, *Proceedings of Second World Congress of Chemical Engineering*, Montreal, vol. 6 (1981) pp. 333–337.

Jeffries, R., "Bicomponent Fibres", Merrow Monograph Publ. Co. Ltd., 1971, pp. v & 1–70.

Abstract of Japan 63–61,038 (published Mar. 17, 1988).

Abstract of Japan 63–168,445 (published Jul. 12, 1988).

PROCESS OF MAKING HIGH THERMAL BONDING STRENGTH FIBER

BACKGROUND

The instant application is a continuation-in-part of U.S. Ser. No. 474,897, filed on Feb. 5, 1990, abandoned in favor of U.S. Ser. No. 07/887,416 filed May 20, 1992, and relates to a melt spun process and corresponding fiber or filament suitable for obtaining durable high strength nonwoven material through control over polymer degradation and quench steps.

A number of modern uses have been found for nonwoven materials produced from melt spun polymers, particularly degraded polyolefin-containing compositions. Such uses, in general, demand special properties of the nonwoven and corresponding fiber such as special fluid handling, high vapor permeability, softness, integrity and durability, as well as efficient cost-effective production techniques.

Unfortunately, however, the achievement of properties such as softness, and vapor-permeability, for example, can result in serious, technical problems with respect to strength, durability and efficiency of production of the respective staple and nonwoven product.

One particularly troublesome and long-standing technical problem stems from the fact that efficient, high speed spinning and processing of polyolefin fiber such as isotactic polypropylene fiber requires careful control over the melt flow rate (MFR) of the spun melt, and a highly efficient quenching step for avoiding substantial over- or under-quench rate leading either to melt fracture and/or ductile failure under high speed commercial manufacturing conditions. Deficient fiber or filaments can vary substantially in strength and web bonding properties.

It is an object of the present invention to improve process control over polymer degradation, spin and quench steps, and also to obtain fiber capable of producing nonwoven fabric having increased strength, elongation, toughness, and integrity.

It is a further object to improve the heat bonding properties of fiber or filament spun from polyolefin?-containing spun melt comprising polypropylene polymer, copolymer, or alloys thereof.

THE INVENTION

The above objects are realized in the instant process whereby monocomponent and/or bicomponent fiber having improved heat bonding properties plus corresponding nonwoven material strength, elongation, and toughness is obtained, comprising A. admixing an effective amount of at least one antioxidant/stabilizer composition into a melt spun mixture comprising spinnable broad molecular weight (weight average/number average molecular weight) distribution polyolefin polymer, copolymer or alloy thereof, such as polypropylene-containing spun melt as hereafter defined.

Various other additives known to the spinning art can also be incorporated, as desired, such as whiteners, colorants and pigments such as $TiO_2$, pH-stabilizing agents such as ethoxylated stearyl amine and calcium stearate; antioxidants, lubricants, and antistatic agents in usual amounts (i.e. cumulatively about0.1%–10% or more based on weight).

B. heating and extruding the spun melt at a temperature, preferably within a range of about 250° C.–325° C. for polyolefins, and an environment under conditions minimizing oxidative chain scission degradation of polymeric component(s) within the spun melt;

C. immediately exposing the resulting hot extrudate to air or oxygen-rich atmosphere to permit oxygen diffusion into the hot extrudate and effect at least superficial oxidative chain scission degradation of resulting hot extrudate filaments; and D. fully quenching and taking up the resulting partially degraded filaments to obtain a highly degraded fiber or filament surface zone of low molecular weight, lowered melting point, and low birefringence (ref. (3) and (6) FIGS. 1 and 2), and a minimally degraded inner zone comprising normal crystalline birefringent configuration having a higher melting point (ref. (1) and (4), these two zones representing extremes bounding and defining an intermediate zone (ref. 2) and (5) of intermediate oxidative chain scission degradation and crystallinity, the thickness of which depends essentially upon fiber geometry or structure, and the rate and permitted duration of oxygen diffusion into the hot extrudate, fiber or filament.

Figure 1:
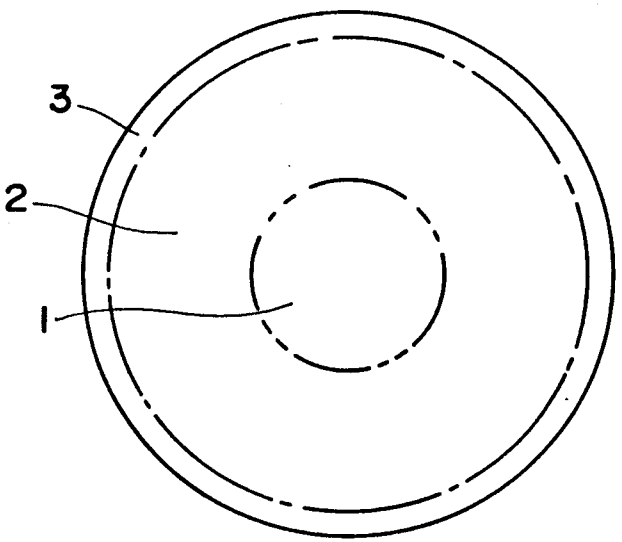

The resulting fiber or filament is further characterized as the spun product of a broad molecular weight polyolefin polymer or copolymer, preferably a polypropylene-containing spun melt having incorporated therein an effective amount of at least one antioxidant/-stabilizer composition, the resulting fiber or filament, when quenched, comprising, in combination, (ref. FIGS. 1 and 2 discussed in full and representing schematic fiber cross-sections respectively of a mono- and a bicomponent configuration) in which (1) or (4) represents an inner zone identified by a substantial lack of oxidative polymeric degradation, high birefringence, a higher melting point than 3 or 6, and a weight average molecular weight within a range of about 100,000–450,000 grams/mole and preferably about 100,000–250,000 grams/mole. In general such zone is further characterized by having MFR values within a range of about 5–25 dg/min.;

(2) or (5) represents an intermediate zone external to the inner zone and further identified by an inside-to-outside increase in the amount of oxidative chain scission polymeric degradation, the polymeric material within such intermediate zone having a molecular weight within a range from that of said inner zone down to a minimum of less than about 20,000 grams/mole and preferably down to a minimum of about 10,000 grams/-mole and an MFR of about 15–50 dg/min.;

(3) or (6) represents a surface zone external to the intermediate zone and defining the outside surface of a fiber or filament, such surface zone being further identified by low birefringence, a lower melting point than (1) and (2), or (4) and (5), a high concentration of oxidative chain scission-degraded polymeric material plus a weight average molecular weight of less than about 10,000 and preferably about 5,000–10,000 grams/mole. In general, such zone is further characterized as having an MFR value within a range of about 25–1000 dg/min., in general, the corresponding oxidized fiber material having about a 20%–200% increase in MFR over corresponding nonoxidized fiber material, and (7), as shown in FIG. 2, schematically represents, in cross section, a core element internally contiguous with inner zone (7), which can be generated from nondegraded polyolefin or some entirely different thermoplastic spun melt composition from that used in forming the sheath elements, but wettable thereby.

For present purposes sheath elements (4), (5) and (6) are identified as substantially the same type-material in the same adjacent relationship as counterpart elements (1), (2), and (3) of FIG. 1.

Bicomponent fiber as represented by FIG. 2, can be conventionally spun by utilizing equipment and techniques well known to the fiber-producing art (ref. U.S. Pat. Nos. 3,807,917, 4,251,200, 4,717,325 and as set out in "Bicomponent Fibers" R. Jeffries, Merrow Monograph Publishing Co. 1971.

In any case, the elements or zones shown in cross section in FIGS. 1 and 2 are not necessarily visually distinguishable in actual test samples, nor do FIGS. 1-2 represent a precise geometric depth of oxygen diffusion within the spun fiber or filament since fiber of different known cross sectional configurations and diffusibility are includable within the scope of the present invention.

The molecular weight values of the aforementioned zones, inner, intermediate, and surface, are representative of a continuous gradient of molecular weight values from the inner to the surface regions of the cross-section of the fiber.

The molecular weight degradation of the molecules in the fiber can be characterized in an additional way. First, the melt flow rate, MFR,* of the fiber varies continuously with the amount of quench delay. More quench delay provides higher levels of molecular weight degradation. Accordingly, characterizing the MFR with respect to quench delay provides a measure of the gradation of molecular weight from inner to outer zones, since molecular weight is inversely proportional to MFR.

(*) in accordance with ASTM 1238

For present purposes the term "effective amount", as applied to the concentration of antioxidant or stabilizer compositions within the dry spun melt mixture, is conveniently defined as an amount, based on dry weight, which is capable of preventing or at least substantially limiting chain scission degradation of hot polymeric component(s) within a fiber spinning temperature range and in the substantial absence of oxygen, an oxygen evolving, or an oxygen-containing gas. In particular, it is defined as the concentration of one or more antioxidant (effectively a melt stabilizer) compositions in the spun melt sufficient to effectively limit chain scission degradation of the polyolefin component of the heated spun melt operating within a temperature range of about 250° C. to about 325° C., in the substantial absence of an oxidizing environment. The presence of an "effective amount" of such additive however, shall not prevent oxidative chain scission degradation from occurring in the presence of oxygen diffusion, commencing at or about the spun filament threadline and extending downstream to a point where natural heat loss and/or an applied quenching environment lowers the fiber surface temperature to about 250° C. or below, (in the case of polypropylene polymer or copolymer) to a point where further oxygen diffusion into the spun fiber or filament becomes negligible. Conversely, in the absence of oxygen in the quench gas, no measurable molecular weight degradation nor increase in MFR is anticipated.

Generally speaking, and for purposes of spinning polypropylene filament, the total combined antioxidant stabilizer concentration conveniently falls within a range of about 0.002%-1% by weight, and preferably within a range of about 0.005%-0.5%, the exact amount depending on the particular rheological properties of the chosen broad molecular weight polymeric component(s) and the proposed temperature of the spun melt; additional parameters are represented by the temperature and pressure conditions expected within the spinnerette itself, and the amount of prior exposure to residual amounts of oxidant while in a heated state upstream of the spinnerette. Below or downstream of the spinnerette an oxygen rich atmosphere such as an oxygen/nitrogen gas flow ratio of about 100-10:0-90 by volume at an ambient temperature up to about 325° C., plus a delayed full quench are preferred to assure adequate chain scission degradation of the spun filament and to provide improved thermal bonding characteristics, leading to increased strength and toughness of nonwovens formed from such fiber or staple.

The term "active amount of a degrading composition" is here defined as extending from 0% up to a concentration, by weight, sufficient to supplement the application of heat and pressure to a dry spun melt mix plus the choice of polymer component to arrive at a spinnable (resin) MFR value within a range of about 5 to 35 dg/min. By further definition and using a broad molecular weight polypropylene-containing spun melt, an "active amount" constitutes the amount which, at a melt temperature range of about 275° C.-325° C. is capable of producing or obtaining a melt within the above-stated desirable MFR range.

The term "antioxidant/stabilizer composition", as here used, comprises one or more art-recognized antioxidant or melt stabilizer compositions employed in effective amounts, inclusive of phenylphosphites such as Irgafos® 168(*2), Ultranox® 626(*5) Sandostab PEP-Q(*4); N,N'bis-piperidinyl diamine-containing compositions such as Chimassorb® 119(*2) or 944(*2); hindered phenolics such as Cyanox® 1790(*3), Irganox® 1076(*2) or 1425(*2) and the like.

(*2) commercially obtainable as products of Ciba Geigy Corp.
(*3) commercially obtainable as products of American Cyanamid Co.
(*4) commercially obtainable as a product of Sandos Chemical Co.
(*5) commercially obtainable as a product of General Electric.

The term "broad molecular weight distribution", is here defined as dry polymer pellet, flake or grain preferably having an MWD value (i.e. Wt.Av.Mol.Wt./No.Av.Mol.Wt.) of not less than about 5.5 or higher. For present purposes a range of about 5.6-11.11 are preferred values.

The term "quenching and taking up", as here used, is defined as a process step generic to one or more of the steps of gas quench, fiber draw (primary and secondary if desired) and texturing, (optionally inclusive of one or more of the routine steps of bulking, crimping, cutting and carding), as desired.

As above noted, the spun fiber obtained in accordance with the present invention can be continuous and/or staple fiber of a monocomponent- or bicomponent-type and preferably falls within a denier-per-filament (dpf) range of about 1-30 or higher.

In the latter bicomponent type, the corresponding inner layer of the sheath element is comparable to the center cross sectional area of a monocomponent fiber, however, the bicomponent core element of a bicomponent fiber is not necessarily degraded or treated in accordance with the instant process or even consist of the same polymeric material as the sheath component, although it should be generally compatible with or wettable by the inner zone of the sheath component;

As above noted, the instant invention does not necessarily require the addition of a conventional polymer degrading agent in the spun melt mix, although such use is not precluded by this invention in cases where a low spinning temperature and/or pressure (i.e. less than 1800 psi) is preferred, or if, for other reasons, the MFR value of the heated polymer melt is otherwise unsuitable for efficient spinning. In general, however, a suitable MFR (melt flow rate) for initial spinning purposes is best obtained by careful choice of a broad molecular weight polyolefin-containing polymer of greater than about 5.6 to provide the needed rheological and morphological properties when operating within a spun melt temperature range of about 275° C.–320° C. for polypropylene. "(3)" represents an approximate oxygen-diffused surface zone characterized by highly degraded polymer of less than about 10,000 (wt Av Mw) and preferably falling within a range of about 5,000–10,000 g/mole with an MFR value of about 25–1000 dg/min., and at least initially with a high smectic and/or beta crystal configuration; "(2)" represents an approximate intermediate zone, preferably one having a polymer component varying from about 450,000-to- about 10,000–20,000 g/mole (inside-to-outside), the thickness and steepness of the decomposition gradient depending substantially upon the extended maintenance of fiber heat, initial polymer MWD, and the rate of oxidant gas diffusion, plus the relative amount of oxygen residually present in the dry spun mix which diffuses into the hot spun fiber upstream, during spinning and prior to the take up and quenching steps; inner zone "(1)", on the other hand, represents an approximate zone of relatively high birefringence and minimal or no oxidative chain scission (MFR 5–25 dg/min.) due to a low or nonexistent oxygen concentration. As earlier noted, this zone usefully has a molecular weight within a range of about 100,000–450,000 grams/mole.

FIG. 2 represents a bicomponent-type fiber also within the scope of the present invention, in which (4), (5) and (6) are defined substantially as counterparts of (1)–(3) of FIG. 1 while (7) represents a spinnable bicomponent core zone which, if desired, can be formed from a separate spun melt composition obtained and applied using a spin pack in a conventional manner (*6), provided inner layer (4) consists of a compatible (i.e. core-wettable) material. In addition, zone (7) is preferably formed and initially sheath-coated in a substantially nonoxidative environment in order to minimize the formation of a low-birefringent low molecular weight interface between zones (7) and (4).

(*6) "Bicomponent Fibers" R. Jeffries, Merrow Monograph Publishing Company, 1971.

As before, the quenching step of the spun bicomponent fiber is preferably delayed at the threadline, conveniently by partially blocking the quench gas, and air, ozone, oxygen, or other conventional oxidizing environment (heated or ambient temperature) is provided downstream of the spinnerette, to assure sufficient oxygen diffusion into the sheath element and oxidative chain scission within at least surface zone (6) and preferably both (6) and (5) zones of the sheath element.

Yarns as well as webs for nonwoven material are conveniently formed from fibers or filaments obtained in accordance with the present invention by jet bulking (optional), cutting to staple (optional), crimping (optional), and laying down the fiber or filament in conventional ways and as demonstrated, for instance, in U.S. Pat. Nos. 2,985,995, 3,364,537, 3,693,341, 4,500,384, 4,511,615, 4,259,399, 4,480,000, and 4,592,943.

While FIGS. 1 and 2 show generally circular fiber cross sections, the present invention is not limited to such configuration, conventional diamond, delta, trilobal, oval, "Y" shaped, "X" shaped cross sections and the like are equally applicable to the instant invention.

The present invention is further demonstrated, but not limited to the following Examples.

EXAMPLE I

Dry melt spun compositions identified hereafter as SC-1 through SC-14 are individually prepared by tumble mixing linear isotactic polypropylene flake identified as "A"–"E" in Table I*7 and having Mw/Mn values of about 5.4 to 11.11 and a Mw range of 195,000–359,000 grams/mole, which are admixed respectively with about 0.1% by weight of conventional melt stabilizer(s). The mix is then heated and spun as circular cross section fiber at a temperature of about 300° C. under a nitrogen atmosphere, using a standard 782 hole spinnerette at a speed of 750–1200 M/m. The fiber thread lines in the quench box are exposed to a normal ambient air quench (cross blow) with up to about 5.4% of the upstream jets (i.e. area of cross blow) in the quench box blocked off to delay the quenching step. The resulting continuous filaments, having spin denier within a range of 2.0–3.5 dpf, are then drawn (1.0 to 2.5×), crimped (stuffer box steam), cut to 1.5 or 1.875 inches, and carded to obtain conventional fiber webs. Three ply webs of each staple are identically oriented and stacked (primarily in the machine direction), and bonded, using a diamond design calender at respective temperatures of about 157° C. or 165° C., and 160 to 240 PLI (pounds/linear inch) to obtain test nonwovens weighing 17.4–22.8 gm/yd$^2$. Test strips of each nonwoven (1"×7") are then identically conventionally tested for CD strength*8, elongation and toughness*9. The fiber parameters and fabric strengths are reported in Tables II–IV below using the polymers described in Table I in which the "A" polymers (Table I) are used as controls.

(*7) Obtained commercially from Himont Incorporated.

(*8) Using a tensile tester of Instron Incorporated.

(*9) Energy required to break fabric conventionally, based on stress/-strain curve values.

EXAMPLE 2 (Controls)

Example I is repeated, utilizing polymer A and/or other polymers with a low Mw/Mn of 5.35 and/or full (non-delayed) quench. The corresponding webs and test nonwovens are otherwise identically prepared and identically tested as in Example 1. Test results of the controls, identified as C-1 through C-10 are reported in Tables II–IV.

TABLE I

| Spun Mix Polymer Identification | $\overline{M}w$ (g/mol) | Sec(*10) Mn (g/mol) | $\overline{M}w/\overline{M}n$ | Intrinsic Visc. IV (deciliters/g) | MFR (gm/10 min) |
|---|---|---|---|---|---|
| A | 229,000 | 42,900 | 5.35 | 1.85 | 13 |
| B | 359,000 | 46,500 | 7.75 | 2.6 | 5.5 |
| C | 290,000 | 44,000 | 6.59 | 2.3 | 8 |
| D | 300,000 | 42,000 | 7.14 | 2.3 | 8 |

TABLE I-continued

| Spun Mix Polymer Identification | $\overline{M}w$ (g/mol) | Sec(*10) Mn (g/mol) | $\overline{M}w/\overline{M}n$ | Intrinsic Visc. IV (deciliters/g) | MFR (gm/10 min) |
|---|---|---|---|---|---|
| E | 256,000 | 23,000 | 11.13 | 2.0 | 10 |

(*10) Size exclusion chromatography.

TABLE II

| Melt Sample | Polymer | MWD | Spin Temp °C. | Area % Quench Box* Blocked Off | Comments |
|---|---|---|---|---|---|
| C-1 | A | 5.35 | 298 | 3.74 | Control |
| SC-1 | C | 6.59 | 305 | 3.74 | \| 5.5 MWD |
| SC-2 | D | 7.14 | 309 | 3.74 | \| 5.5 MWD |
| SC-3 | B | 7.75 | 299 | 3.74 | \| 5.5 MWD |
| C-2 | A | 5.35 | 298 | 3.74 | Control <5.5 MWD |
| C-3 | A | 5.35 | 300 | 3.74 | Control <5.5 MWD |
| C-4 | A | 5.35 | 298 | 3.74 | Control <5.5 MWD |
| SC-4 | D | 7.14 | 309 | 3.74 | No antioxidant |
| SC-5 | D | 7.14 | 312 | 3.74 | — |
| SC-6 | D | 7.14 | 314 | 3.74 | — |
| SC-7 | D | 7.14 | 309 | 3.74 | — |
| SC-8 | C | 6.59 | 305 | 5.38 | |
| SC-9 | C | 6.59 | 305 | 3.74 | |
| C-5 | C | 6.59 | 305 | 0 | Control/Full Quench |
| C-6 | A | 5.35 | 290 | 5.38 | Control <5.5 MWD |
| C-7 | A | 5.35 | 290 | 3.74 | Control <5.5 MWD |
| C-8 | A | 5.35 | 290 | 0 | Control <5.5 MWD |
| SC-10 | D | 7.14 | 312 | 3.74 | |
| C-9 | D | 7.14 | 312 | 0 | Control/Full Quench |
| SC-11 | B | 7.75 | 278 | 4.03 | — |
| SC-12 | B | 7.75 | 299 | 3.74 | — |
| SC-13 | B | 7.75 | 300 | 3.74 | — |
| C-10 | A | 5.35 | 298 | 3.74 | Control/<5.5 MWD |
| SC-14 | E | 11.11 | 303 | 3.34 | — |
| C-11 | A | 5.35 | 293 | 3.34 | Control/<5.5 MWD |
| SC-15 | E | 11.11 | 297 | 3.34 | — |

TABLE III

| Melt Sample | FIBER PROPERTIES MFR (dg/min) | RPI(*11) | dpf | Tenacity (g/den) | Elongation % | Comments |
|---|---|---|---|---|---|---|
| C-1 | 25 | 4.2 | 2.50 | 1.90 | 343 | Effect of MWD |
| SC-1 | 25 | 5.3 | 2.33 | 1.65 | 326 | |
| SC-2 | 26 | 5.2 | 2.19 | 1.63 | 341 | |
| SC-3 | 15 | 5.3 | 2.14 | 2.22 | 398 | |
| C-2 | 17 | 4.6 | 2.28 | 1.77 | 310 | Additives |
| C-3 | 14 | 4.6 | 2.25 | 1.74 | 317 | Effect |
| C-4 | 21 | 4.5 | 2.48 | 1.92 | 380 | Low MWD |
| SC-4 | 35 | 5.4 | 2.28 | 1.59 | 407 | High MWD |
| SC-5 | 22 | 5.1 | 2.33 | 1.64 | 377 | Additives |
| SC-6 | 14 | 5.6 | 2.10 | 1.89 | 357 | Effect |
| SC-7 | 17 | 5.6 | 2.48 | 1.54 | 415 | |
| SC-8 | 23+ | 5.3 | 2.64 | 1.50 | 327 | Quench |
| SC-9 | 25 | 5.3 | 2.33 | 1.65 | 326 | Delay |
| C-5 | 23 | 5.3 | 2.26 | 1.93 | 345 | |
| C-6 | 19 | 4.5 | 2.28 | 1.81 | 360 | Quench |
| C-7 | 17 | 4.5 | 2.26 | 1.87 | 367 | Delay |
| C-8 | 18 | 4.5 | 2.28 | 1.75 | 345 | |
| SC-10 | 22 | 5.1 | 2.33 | 1.64 | 377 | Quench |
| C-9 | 15 | 5.2 | 2.18 | 1.82 | 430 | Delay |
| SC-11 | 11 | 5.4 | 2.40 | 2.00 | 356 | — |
| SC-12 | 15 | 5.3 | 2.14 | 2.22 | 398 | — |
| SC-13 | 24 | 5.1 | 2.59 | 1.65 | 418 | — |
| C-10 | 28 | 4.2 | 3.04 | 1.87 | 368 | Effect of MWD |
| SC-14 | 22 | 4.7 | 2.88 | 1.86 | 367 | |
| C-11 | 27 | 4.2 | 2.30 | 1.86 | 340 | Effect of MWD |
| SC-15 | 20 | 4.6 | 2.27 | 1.80 | 365 | |

(*11) RPI = rheological polydispersity index: Zeichner et al. "A Comprehensive Evaluation of Polypropylene Melt Rheology", Proceedings 2nd World Congress of Chem. Engr.; Oct. 1981, Pg. 333-337.

TABLE IV

| Melt Sample | CALENDER Temp (°C.) | FABRIC Weight (g/sq yd.) | CDS (g/in.) | CDE (% in.) | TEA (g/in.) |
|---|---|---|---|---|---|
| | FABRIC CHARACTERISTICS (Variation in Calender Temperatures) | | | | |
| C-1 | 157 | 22.8 | 153 | 51 | 42 |
| SC-1 | 157 | 21.7 | 787 | 158 | 704 |
| SC-2 | 157 | 19.2 | 513 | 156 | 439 |
| SC-3 | 157 | 18.7 | 593 | 107 | 334 |
| C-2 | 157 | 18.9 | 231 | 86 | 106 |
| C-3 | 157 | 21.3 | 210 | 73 | 83 |
| C-4 | 157 | 20.5 | 275 | 74 | 110 |
| SC-4 | 157 | 18.3 | 226 | 83 | 102 |
| SC-5 | 157 | 20.2 | 568 | 137 | 421 |
| SC-6 | 157 | 19.1 | 429 | 107 | 245 |
| SC-7 | 157 | 21 | 642 | 136 | 485 |
| SC-8 | 157 | 19.8 | 498 | 143 | 392 |
| SC-9 | 157 | 21.7 | 787 | 158 | 704 |
| C-5 | 157 | 19.4 | 467 | 136 | 350 |
| C-6 | 157 | 19.1 | 399 | 106 | 233 |
| C-7 | 157 | 19.8 | 299 | 92 | 144 |
| C-8 | 157 | 17.4 | 231 | 83 | 105 |
| SC-10 | 157 | 20.2 | 568 | 137 | 421 |
| C-9 | 157 | 20.4 | 448 | 125 | 300 |
| SC-11 | 157 | 19.4 | 274 | 86 | 122 |
| SC-12 | 157 | 18.7 | 593 | 107 | 334 |
| SC-13 | 157 | 19.4 | 688 | 132 | 502 |
| C-10 | 154 | 18.9 | 343 | 90 | 175 |
| SC-14 | 154 | 19.6 | 571 | 123 | 389 |
| C-11 | 157 | 21.2 | 535 | 114 | 337 |
| SC-15 | 157 | 20.0 | 582 | 140 | 459 |
| C-1 | 165 | 20.3 | 476 | 98 | 250 |
| SC-1 | 165 | 22.8 | 853 | 147 | 710 |
| SC-2 | 165 | 19 | 500 | 133 | 355 |
| SC-3 | 165 | 19.7 | 829 | 118 | 528 |
| C-2 | 165 | 18.8 | 412 | 120 | 262 |
| C-3 | 165 | 20.2 | 400 | 112 | 235 |
| C-4 | 165 | 20.6 | 453 | 102 | 250 |
| SC-4 | 165 | 19.3 | 400 | 110 | 239 |
| SC-5 | 165 | 17.9 | 614 | 151 | 532 |
| SC-6 | 165 | 19.9 | 718 | 142 | 552 |
| SC-7 | 165 | 20.5 | 753 | 157 | 613 |
| SC-8 | 165 | 20.4 | 568 | 149 | 468 |
| SC-9 | 165 | 22.8 | 853 | 147 | 710 |
| C-5 | 165 | 17.4 | 449 | 126 | 303 |
| C-6 | 165 | 18.5 | 485 | 117 | 307 |
| C-7 | 165 | 19.7 | 482 | 130 | 332 |
| C-8 | 165 | 19.2 | 389 | 103 | 214 |
| SC-10 | 165 | 17.9 | 614 | 151 | 532 |
| C-9 | 165 | 19.4 | 552 | 154 | 485 |
| SC-11 | 165 | 20.1 | 544 | 127 | 366 |
| SC-12 | 165 | 19.7 | 829 | 118 | 528 |
| SC-13 | 165 | 19.2 | 746 | 138 | 576 |
| C-10 | 163 | 22.0 | 622 | 111 | 385 |
| SC-14 | 163 | 22.2 | 787 | 136 | 598 |
| C-11 | 166 | 21.7 | 616 | 112 | 378 |
| SC-15 | 166 | 20.7 | 686 | 127 | 485 |

What I claim and protect by Letters Patent is:

1. A process for preparing at least one polypropylene containing fiber or filament, comprising:

extruding polypropylene containing material having a molecular weight distribution of at least about 5.6 to form at least one hot extrudate having a surface; and controlling quenching of the at least one hot extrudate in an oxygen containing atmosphere so as to effect oxidative chain scission degradation of the surface to obtain at least one polypropylene containing fiber or filament.

2. The process according to claim 1, wherein the polypropylene containing material has a molecular weight distribution of at least about 6.

3. The process according to claim 2, wherein the polypropylene containing material has a molecular weight distribution of at least about 7.

4. The process according to claim 3, wherein the polypropylene containing material has a molecular weight distribution of at least about 8.

5. The process according to claim 1, wherein the polypropylene containing material subjected to extrusion includes a member selected from the group consisting of antioxidants, stabilizers, and mixtures thereof.

6. The process according to claim 1, wherein the polypropylene containing material subjected to extrusion includes at least one of phenylphosphite and a N,N' bis-piperidinyl diamine derivative.

7. The process according to claim 1, wherein the polypropylene containing material is extruded from an extruder and includes a member selected from the group consisting of antioxidants, stabilizers, and mixtures thereof, in an effective amount to control chain scission degradation of polymeric components in the extruder.

8. The process according to claim 1, wherein the controlling quench of the at least one hot extrudate in an oxygen containing atmosphere to effect oxidative chain scission degradation of the surface of the at least one fiber or filament includes controlling rate of quenching of the hot extrudate.

9. The process according to claim 8, wherein the controlling quenching comprises delaying quenching of the at least one hot extrudate.

10. The process according to claim 9, wherein the oxygen containing quenching atmosphere comprises a cross-blow quench, and an upper portion of the cross-blow quench is blocked.

11. The process according to claim 10, wherein up to about 5.4% of the cross-blow is blocked.

12. The process according to claim 1, wherein the at least one polypropylene containing fiber or filament comprises a monocomponent or a bicomponent fiber or filament.

13. The process according to claim 1, wherein the polypropylene containing material is extruded at a temperature of about 250° C. to 325° C.

14. The process according to claim 13, wherein the polypropylene containing material is extruded at a temperature of about 275° C. to 320° C.

15. The process according to claim 1, wherein the controlling quench of the at least one hot extrudate in an oxygen containing atmosphere so as to effect oxidative chain scission of the surface comprises maintaining the temperature of the at least one hot extrudate above about 250° C. for a period of time to obtain oxidative chain scission degradation of the surface.

16. The process according to claim 15, wherein the controlling quenching includes blocking an upper portion of a cross-blow quench.

17. The process according to claim 15, wherein the controlling quenching includes passing the at least one hot extrudate through a blocked zone.

18. The process according to claim 17, wherein the blocked zone is open to the oxygen containing atmosphere.

19. A process for preparing at least one polypropylene containing fiber or filament, comprising:

extruding polypropylene containing material having a molecular weight distribution of at least about 5.6 to form at least one hot extrudate having a surface, the polypropylene containing material including a member selected from the group consisting of antioxidants, stabilizers, and mixtures thereof, in an effective amount to at least substantially limit chain scission degradation of polymeric components in the extruder; and controlling quenching of the at least one hot extrudate in an oxygen containing atmosphere so as to effect oxidative chain scission degradation of the surface, the controlling quenching including maintaining the at least one hot extrudate at a temperature for a sufficient period of time to permit oxidative chain scission degradation of the surface of the hot extrudate to obtain at least one polypropylene containing fiber or filament.

20. A process for preparing at least one polypropylene containing fiber or filament, comprising:

extruding polypropylene containing material having a molecular weight distribution of at least about 5.6 to form at least one hot extrudate having a surface; and controlling quenching of the at least one hot extrudate in an oxygen containing atmosphere so as to obtain at least one polypropylene containing fiber or filament having a decreasing weight average molecular weight towards the surface of the at least one fiber or filament, and an increasing melt flow rate towards the surface of the at least one fiber or filament.

21. The process according to claim 20, wherein the at least one fiber or filament comprises an inner zone including a weight average molecular weight of about 100,000 to 450,000 grams/mole.

22. The process according to claim 21, wherein the inner zone comprises a weight average molecular weight of about 100,000 to 250,000 grams/mole.

23. The process according to claim 21, wherein the inner zone comprises a melt flow rate of 5–25 dg/min.

24. The process according to claim 21, wherein the at least one fiber or filament comprises an outer zone including the surface of the at least one fiber or filament, and the outer zone comprises a weight average molecular weight of less than about 10,000 grams/mole.

25. The process according to claim 24, wherein the outer zone comprises a weight average molecular weight of about 5,000 to 10,000 grams/mole.

26. The process according to claim 24, wherein the outer zone comprises a melt flow rate of about 25–1000 dg/min.

27. The process according to claim 24, including an intermediate zone positioned between the inner zone and the outer zone having a weight average molecular weight and melt flow rate intermediate the inner zone and the outer zone.

28. The process according to claim 24, wherein the inner zone has a high birefringence, and the outer zone has a low birefringence.

29. The process according to claim 20, wherein the polypropylene containing material is extruded from an extruder and includes a member selected from the group consisting of antioxidants, stabilizers, and mixtures thereof, in an effective amount to control chain scission degradation of polymeric components of the hot extrudate in the extruder.

30. The process according to claim 20, wherein the at least one fiber or filament comprises a monocomponent or a bicomponent fiber or filament.

31. The process according to claim 20, wherein the polypropylene containing material has a molecular weight distribution of at least about 6.

32. The process according to claim 31, wherein the polypropylene containing material has a molecular weight distribution of at least about 7.

33. The process according to claim 32, wherein the polypropylene containing material has a molecular weight distribution of at least about 8.

34. A process for preparing at least one polypropylene containing fiber or filament, comprising:

extruding polypropylene containing material having a molecular weight distribution of at least about 5.6 to form at least one hot extrudate having a surface, the polypropylene containing material including a member selected from the group consisting of antioxidants, stabilizers, and mixtures thereof, in an effective amount to control chain scission degradation of polymeric components in the hot extrudate in the extruder; and controlling quenching of the at least one hot extrudate in an oxygen containing atmosphere so as to obtain at least one polypropylene containing fiber or filament having a decreasing weight average molecular weight towards the surface of the at least one fiber or filament, and an increasing melt flow rate towards the surface of the at least one fiber or filament, the at least one fiber or filament comprising an inner zone including a weight average molecular weight of about 100,000 to 450,000 grams/mole, and an outer zone, including the surface of the at least one fiber or filament, including a weight average molecular weight of less than about 10,000 grams/mole.

35. The process according to claim 34, wherein the polypropylene containing material has a molecular weight distribution of at least about 6.

36. The process according to claim 35, wherein the polypropylene containing material has a molecular weight distribution of at least about 7.

37. The process according to claim 36, wherein the polypropylene containing material has a molecular weight distribution of at least about 8.

38. A process for preparing at least one polyolefin polymer containing fiber or filament, comprising:

extruding a mixture comprising a broad molecular weight distribution polyolefin polymer and an effective amount of a member selected from the group consisting of antioxidants, stabilizers, and mixtures thereof under conditions to control oxidative chain scission degradation of polymeric components within the mixture prior to entering an oxygen containing atmosphere as a hot extrudate; and exposing the hot extrudate to an oxygen containing atmosphere under conditions to effect oxidative chain scission degradation of a surface of the hot extrudate to obtain at least one polyolefin polymer containing fiber or filament having a highly degraded surface zone of lower molecular weight, and lowered melting point compared to an inner zone of the hot extrudate.

39. The process according to claim 38, comprising controlling quenching of the resulting partially degraded extrudate to obtain a fiber or filament having a degraded surface zone of lower molecular weight and lower melting point, and the inner zone having higher molecular weight and higher melting point.

40. The process according to claim 39, wherein the mixture contains polypropylene, and has a molecular weight distribution of at least about 5.5.

41. The process according to claim 40, wherein the mixture has a molecular weight distribution of at least about 5.6.

42. The process according to claim 41, wherein the mixture has a molecular weight distribution of at least about 6.

43. The process according to claim 42, wherein the mixture has a molecular weight distribution of at least about 7.

44. The process according to claim 43, wherein the mixture has a molecular weight distribution of at least about 8.

45. The process according to claim 38, wherein the exposing of the hot extrudate to an oxygen containing atmosphere so as to effect oxidative chain scission of the surface comprises maintaining the temperature of the at least one hot extrudate above about 250° C. for a period of time to obtain oxidative chain scission degradation of the surface.

46. The process according to claim 45, wherein the controlling quenching includes blocking an upper portion of a cross-blow quench.

47. The process according to claim 45, wherein the controlling quenching includes passing the at least one hot extrudate through a blocked zone.

48. The process according to claim 47, wherein the blocked zone is open to the oxygen containing atmosphere.

49. A process for preparing at least one fiber or filament comprising:

extruding a broad molecular weight distribution polyolefin containing material at a temperature and an environment under conditions minimizing oxidative chain scission degradation of polymeric components within the extruder;

exposing resulting hot extrudate to an oxygen containing atmosphere to permit oxygen diffusion into the hot extrudate to obtain oxidative chain scission degradation of a surface of the resulting hot extrudate; and quenching the resulting hot extrudate to obtain at least one fiber or filament having a surface zone of lower molecular weight and lowered melting point, and an inner zone having higher molecular weight and higher melting point than the surface zone.

50. The process according to claim 49, wherein the inner zone is substantially not degraded by oxygen.

51. The process according to claim 49, wherein the polyolefin containing material contains polypropylene, and has a molecular weight distribution of at least about 5.5.

52. The process according to claim 51, wherein the polyolefin containing material has a molecular weight distribution of at least about 5.6.

53. The process according to claim 52, wherein the polyolefin containing material has a molecular weight distribution of at least about 6.

54. The process according to claim 53, wherein the polyolefin containing material has a molecular weight distribution of at least about 7.

55. The process according to claim 54, wherein the polyolefin containing material has a molecular weight distribution of at least about 8.

56. A process for preparing at least one polypropylene containing fiber or filament, comprising:

extruding a broad molecular weight distribution polypropylene containing material at a temperature and an environment under conditions minimizing oxidative chain scission degradation of polymeric components within the extruder;

exposing resulting hot extrudate to an oxygen containing atmosphere to permit oxygen diffusion into the hot extrudate to obtain oxidative chain scission degradation of a surface of the resulting hot extrudate; and quenching the resulting hot extrudate to obtain a degraded at least one polypropylene containing fiber or filament having an average melt flow rate increase of about 20–200% in comparison to corresponding substantially non-oxidized fiber or filament.

57. The process according to claim 56, wherein the at least one fiber or filament comprises a surface zone of lower molecular weight and lowered melting point, and an inner zone having higher molecular weight and higher melting point than the surface zone.

58. The process according to claim 51, wherein the inner zone is substantially not degraded by oxygen.

59. The process according to claim 56, wherein the polyolefin containing material contains polypropylene, and has a molecular weight distribution of at least about 5.5.

60. The process according to claim 59, wherein the polyolefin containing material has a molecular weight distribution of about 5.6.

61. The process according to claim 60, wherein the polyolefin containing material has a molecular weight distribution of at least about 6.

62. The process according to claim 61, wherein the polyolefin containing material has a molecular weight distribution of at least about 7.

63. The process according to claim 62, wherein the polyolefin containing material has a molecular weight distribution of at least about 8.

64. The process according to claim 8, wherein the controlling quenching includes immediately blocking an area as the at least one hot extrudate exits a spinnerette.

65. The process according to claim 15, wherein the controlling quenching includes immediately blocking an area as the at least one hot extrudate exits a spinnerette.

66. The process according to claim 20, wherein the at least one fiber or filament comprises an inner zone having a melt flow rate of 5–25 dg/min.

67. The process according to claim 20, wherein the at least one fiber or filament comprises an outer zone having a melt flow rate of about 25–1000 dg/min.

68. The process according to claim 49, wherein the resulting hot extrudate is immediately exposed to an oxygen containing atmosphere.

69. The process according to claim 56, wherein the resulting hot extrudate is immediately exposed to an oxygen containing atmosphere.

70. The process according to claim 34, wherein the fiber or filament includes an intermediate zone positioned between the inner zone and the outer zone having a weight average molecular weight and melt flow rate intermediate the inner zone and the outer zone.

* * * * *

UNITED STATES PATENT AND TRADEMARK OFFICE

CERTIFICATE OF CORRECTION

PATENT NO. : 5,318,735
DATED : June 7, 1994
INVENTOR(S) : Randall E. Kozulla

It is certified that error appears in the above-indentified patent and that said Letters Patent is hereby corrected as shown below:

Col. 1, line 43, delete --?-- after "polyolefin";

Cols. 7 and 8, Table III under column heading "Elongation %", third row from bottom of Table, --367-- should read "376";

In the Claims, Col. 10, claim 8, line 20, --quench-- should read "quenching"; and In the Claims, Col. 10, claim 15, line 45, --quench-- should read "quenching".

Signed and Sealed this

Fourth Day of April, 1995

*Attest:*

*Attesting Officer*

BRUCE LEHMAN

*Commissioner of Patents and Trademarks*